US007076838B2

(12) United States Patent
Meixner

(10) Patent No.: US 7,076,838 B2
(45) Date of Patent: Jul. 18, 2006

(54) HAND-HELD MACHINE TOOL WITH VIBRATION-DAMPED HANDLE

(75) Inventor: Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/344,207

(22) PCT Filed: Mar. 13, 2002

(86) PCT No.: PCT/DE02/00884

§ 371 (c)(1),
(2), (4) Date: Feb. 10, 2003

(87) PCT Pub. No.: WO03/011532

PCT Pub. Date: Feb. 13, 2003

(65) Prior Publication Data

US 2004/0040729 A1 Mar. 4, 2004

(51) Int. Cl.
*B25G 1/01* (2006.01)

(52) U.S. Cl. ..... 16/431; 16/444; 16/430; 173/162.2

(58) Field of Classification Search ..... 16/110.1, 16/431, 405, 430, 443, 444; 173/210, 211, 173/162.1, 162.2; 294/49
See application file for complete search history.

(56) References Cited

U.S. PATENT DOCUMENTS

| | | | | |
|---|---|---|---|---|
| 3,322,211 A | | 5/1967 | Alabuzhev et al. | |
| 3,788,404 A | * | 1/1974 | Koudelka et al. | 173/211 |
| 4,282,938 A | * | 8/1981 | Minamidate | 173/162.2 |
| 4,576,241 A | * | 3/1986 | Emonet | 173/162.2 |
| 4,673,043 A | | 6/1987 | Greppmair | |
| 4,711,308 A | | 12/1987 | Blaas et al. | |
| 5,025,870 A | * | 6/1991 | Gantner | 173/162.2 |
| 6,076,616 A | | 6/2000 | Kramp et al. | |
| 6,148,930 A | * | 11/2000 | Berger et al. | 173/162.2 |
| 2003/0037937 A1 | * | 2/2003 | Frauhammer et al. | 173/48 |

FOREIGN PATENT DOCUMENTS

| | | | |
|---|---|---|---|
| DE | 41 04 917 A | | 8/1992 |
| DE | 195 03 526 A1 | | 8/1996 |
| EP | 0 206 981 A2 | | 12/1986 |
| GB | 1 549 771 A | | 8/1979 |
| GB | 2086005 A | * | 5/1982 |
| GB | 2 171 045 A | | 8/1986 |
| WO | 98 21014 A | | 5/1998 |

* cited by examiner

*Primary Examiner*—Chuck Y. Mah
*Assistant Examiner*—Michael J. Kyle
(74) *Attorney, Agent, or Firm*—Michael J. Striker

(57) ABSTRACT

A very extensive decoupling of the handle from vibrations in the hand power tool is obtained by the fact that, on each of two legs (5, 7) extending nearly parallel to the longitudinal axis (9) of the hand power tool, at least one lever (19, 21) oriented substantially at a right angle to the machine's longitudinal axis (9) is hinge-mounted at one of its two ends, and by the fact that the levers (19, 21) are hinge-mounted at their other ends to a region of the machine housing (1) located between the two legs (5, 7) of the handle (3).

1 Claim, 3 Drawing Sheets

HAND-HELD MACHINE TOOL WITH VIBRATION-DAMPED HANDLE

BACKGROUND OF THE INVENTION

The present invention concerns a hand power tool with vibration-damped handle that has two legs extending nearly parallel to the longitudinal axis of the hand power tool and that is coupled with the machine housing with spring action.

In the case of hand power tools in particular having a striking drive, e.g., drilling hammers, chipping hammers, and the like, very strong vibrations occur in the machine that are transferred to the handle of the machine and are not only unpleasant for the operator, but they can be harmful as well. For example, measures for damping the handle of a hand power tool against vibrations are made known in DE 195 03 526 A1. These measures include, for example, coupling the handle with the machine housing at one end via a damping spring or a spring system, and interconnecting the handle with the machine housing at the opposite end by means of a pivot joint. In this publication it is also proposed that the two ends of two legs of the handle extending parallel to the longitudinal axis of the hand power tool be interconnected with the machine housing via a vibration-damping material, e.g., a thermoplastic elastomer. It has been common, therefore, to interconnect the handle with the machine housing at two points. Even when one or more coupling points are equipped with damping means, a relatively high transfer of vibrations from the machine housing to the handle still takes place.

The invention is therefore based on the object of providing a hand power tool with a handle of the type mentioned initially that is joined with the machine housing of the hand power tool with the simplest means possible in a largely vibration-damped manner.

SUMMARY OF THE INVENTION

The stated object is attained by the fact that, on each of two legs of the handle, at least one lever oriented substantially at a right angle to the machine's longitudinal axis is hinge-mounted at one of its two ends, and by the fact that the leaves are hinge-mounted at their other ends to a region of the machine housing located between the two legs of the handle. Since the handle is coupled with the machine housing only via the levers and it has no other direct connection points with the machine housing, the handle is largely decoupled from vibrations in the machine housing. Additionally, the handle with the lever design has a great deal of stability.

It is advantageous that the levers hinge-mounted on the individual legs of the handle are of equal length. This ensures that the relative motion between the handle and the machine housing has nearly only one component in the direction of the longitudinal axis of the hand power tool. As a result, nearly no component motions occur in other directions that could impart additional acceleration to the operator's hand.

The levers can either share a common hinge point on the machine housing, or the hinge points of the lever can be located close to each other on the machine housing.

A high level of synchronization of the motions transferred to the two legs of the lever can be obtained by the fact that the ends of the levers hinge-mounted on the machine housing comprise a rounding equipped with teeth, and that the hinge points of the levers are placed on the machine housing in such a way that the teeth on the ends of the levers mesh with each other. This measure largely suppresses any tilting or tipping of the handle.

The guidance and stability of the handle can be improved by the fact that two parallel levers oriented substantially at a right angle to the machine's longitudinal axis are hinge-mounted on the machine housing and on each of the two legs of the handle.

The ends of the legs of the handle preferably bear against the machine housing with spring action. A further advantageous embodiment for damping vibrations of the handle lies in the fact that one or more actuators capable of having electrical open-loop or closed-loop control are located between the handle and the machine housing, which said actuators dampen vibrations in the handle by counteracting a force or motion produced by the vibration of the machine housing.

BRIEF DESCRIPTION OF THE DRAWINGS

The invention will be explained in greater detail below with reference to a plurality of exemplary embodiments shown in the drawings.

DETAILED DESCRIPTION OF THE PREFERRED EMBODIMENTS

Figure 1:
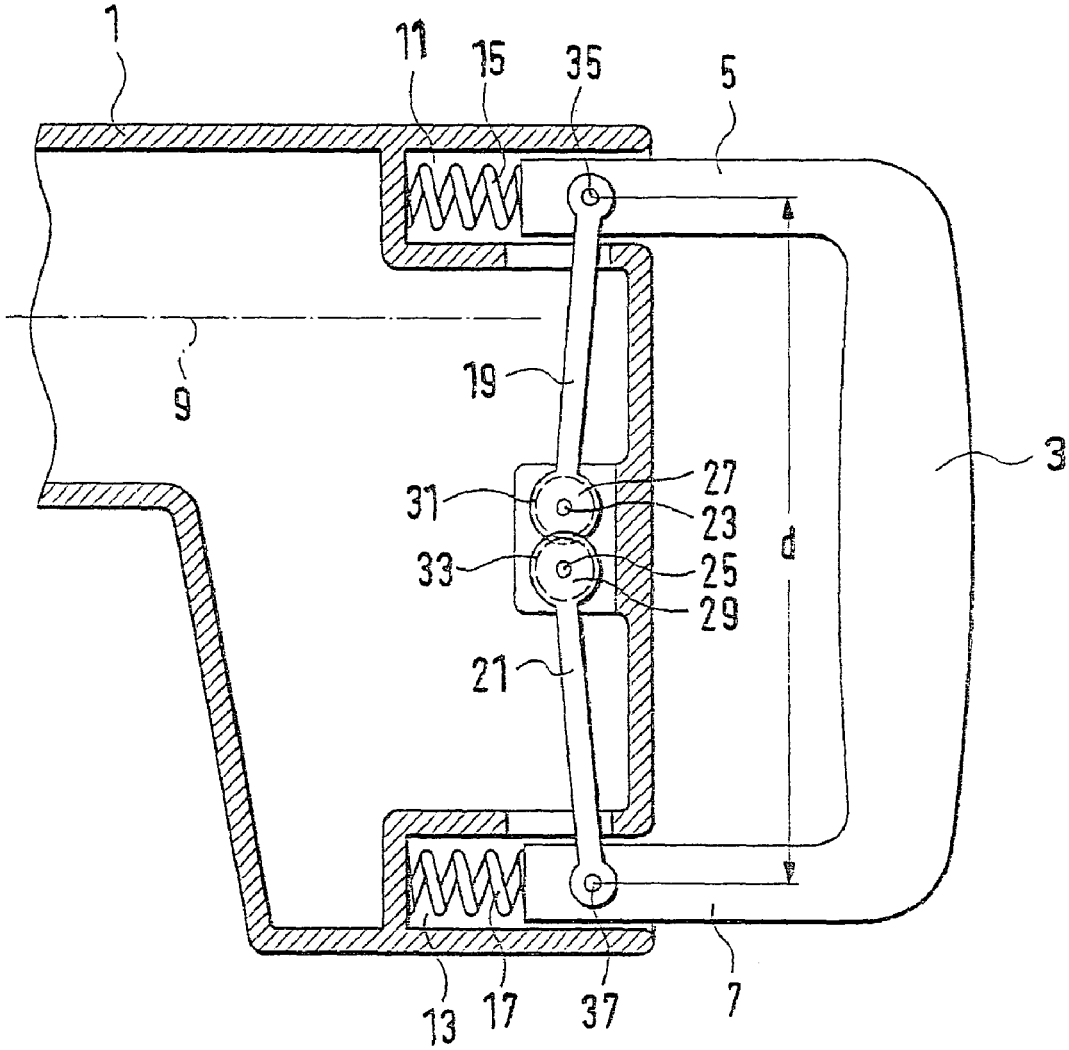
FIG. 1 is a schematic illustration of a handle supported on the machine housing by means of levers, whereby the levers have various hinge points on the machine housing.

A schematic illustration of a hand power tool, e.g., a drilling hammer or a chipping hammer or the like, is shown in FIG. 1. The hand power tool is composed of a machine housing 1 in which the machine drive is located, and a handle 3 coupled with the machine housing 1. The handle 3 is designed in the shape of a "U", and has two legs 5 and 7 that extend nearly parallel to the longitudinal axis 9 of the hand power tool.

The ends of the legs 5 and 7 of the handle 3 preferably extend into pockets 11 and 13 integrally molded on the machine housing 1. In these pockets 11 and 13, the ends of the two legs 5 and 7 bear against the machine housing 1 via spring elements 15 and 17. These spring elements 15 and 17 absorb the contact force applied by the operator to the handle 3. An advantageous embodiment for damping vibrations in the handle lies in the fact that one or more actuators capable of having electrical open-loop or closed-loop control are located between the handle 3—in addition to the springs 15, 17 or without springs—and the machine housing 1, which said actuators dampen vibrations in the handle 3 by counteracting a force or motion produced by the vibration of the machine housing 1. Such actuators are made known, e.g., in EP 0 206 981 A2 or WO 98/21014.

A lever 19, 21 is hinge-mounted on each of the two horizontally extending legs 5 and 7 in such a fashion that it is capable of being pivoted in the direction of the longitudinal axis 9 of the hand power tool. The two levers 19 and 21 are of equal length. The ends of the levers 19 and 21 furthest away from the legs 5 and 7 are hinge-mounted on the machine housing 1 in a region located between the two legs 5 and 7 in such a fashion that they are oriented substantially at a right angle to the machine's longitudinal axis 9. The hinge points 23 and 25 of the two levers 19 and 21 on the machine housing 1 are located close to each other.

The handle can be prevented from tilting or tipping using means that synchronize the motion of the levers 19 and 21. In order to obtain a high level of synchronicity of the movement of the two levers 19 and 21, the ends of the levers 19, 21 hinge-mounted on the machine housing comprise a rounding 27, 29 equipped with teeth 31, 33. The hinge points 23 and 25 of the two levers 19 and 21 are placed in such a fashion, and their roundings 27, 29 equipped with teeth 31, 33 are sized in such a fashion that the teeth 31, 33 on the ends of the levers 19 and 21 mesh with each other.

With the lever mechanism described hereinabove, the handle 3 is largely decoupled from vibrations in the machine housing 1 that are caused by a striking mechanism, for example. The decoupling of the handle from the machine housing is obtained by the fact that, due to the lever mechanism, no direct connection points between the handle 3 and the machine housing 1 are required to give the handle 3 a high amount of stability. The levers 19 and 21 ensure that the handle 3 can make a motion relative to the machine housing 1 nearly exclusively in the direction of the machine's longitudinal axis 9. Other component motions, e.g., tilting or tipping of the handle 3, are nearly ruled out due to the high level of synchronization of the two lever motions.

When the machine is operated and the two levers 19 and 21 are thereby displaced, the distance d between the hinge points 35 and 37 of the two levers 19 and 21 on the horizontal legs 5 and 7 of the handle 3 changes within a range of approx. 0.1 mm. This slight change in the distance d between the hinge points 35 and 37 can be offset by designing the handle 3 in such a fashion or producing it out of such a material that it is permitted to undergo a certain elastic deformation.

Figure 2:
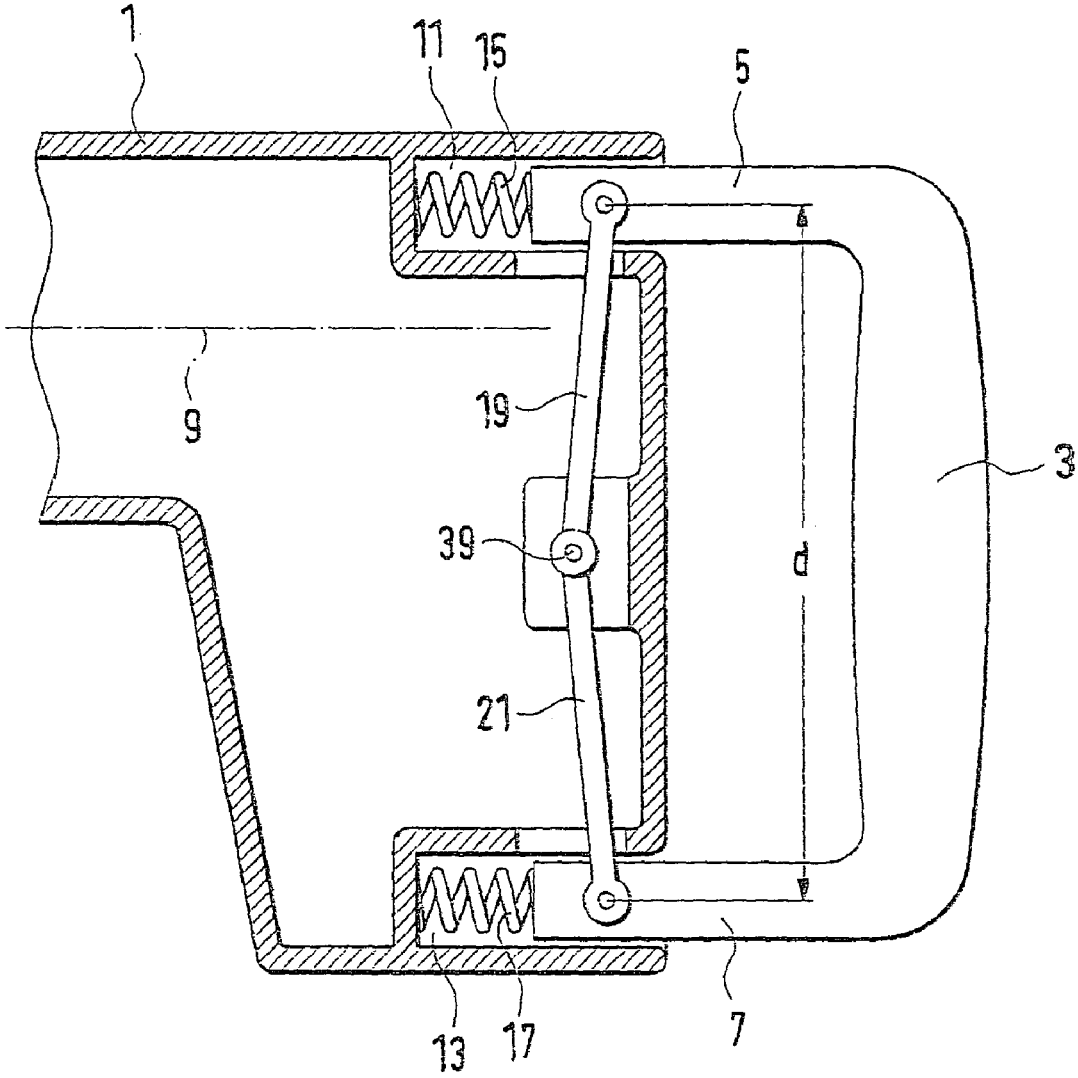
FIG. 2 is a schematic illustration of a handle supported on the machine housing by means of levers, whereby the levers share a common hinge point on the machine housing.

The exemplary embodiment of a hand power tool with a vibration-damped handle shown in FIG. 2 is the same as the exemplary embodiment shown in FIG. 1 except for the hinge-mounting of the two levers 19 and 21 on the machine housing 1. While the two levers 19 and 21 in the exemplary embodiment shown in FIG. 1 comprise hinge points 23 and 25 that are located next to each other, the levers 19 and 21 in the exemplary embodiment shown in FIG. 2 share a common hinge point 39 on the housing 1. In other words, the two levers 19 and 21 are turnably supported on the housing 1 on a common axis 39.

Figure 3:
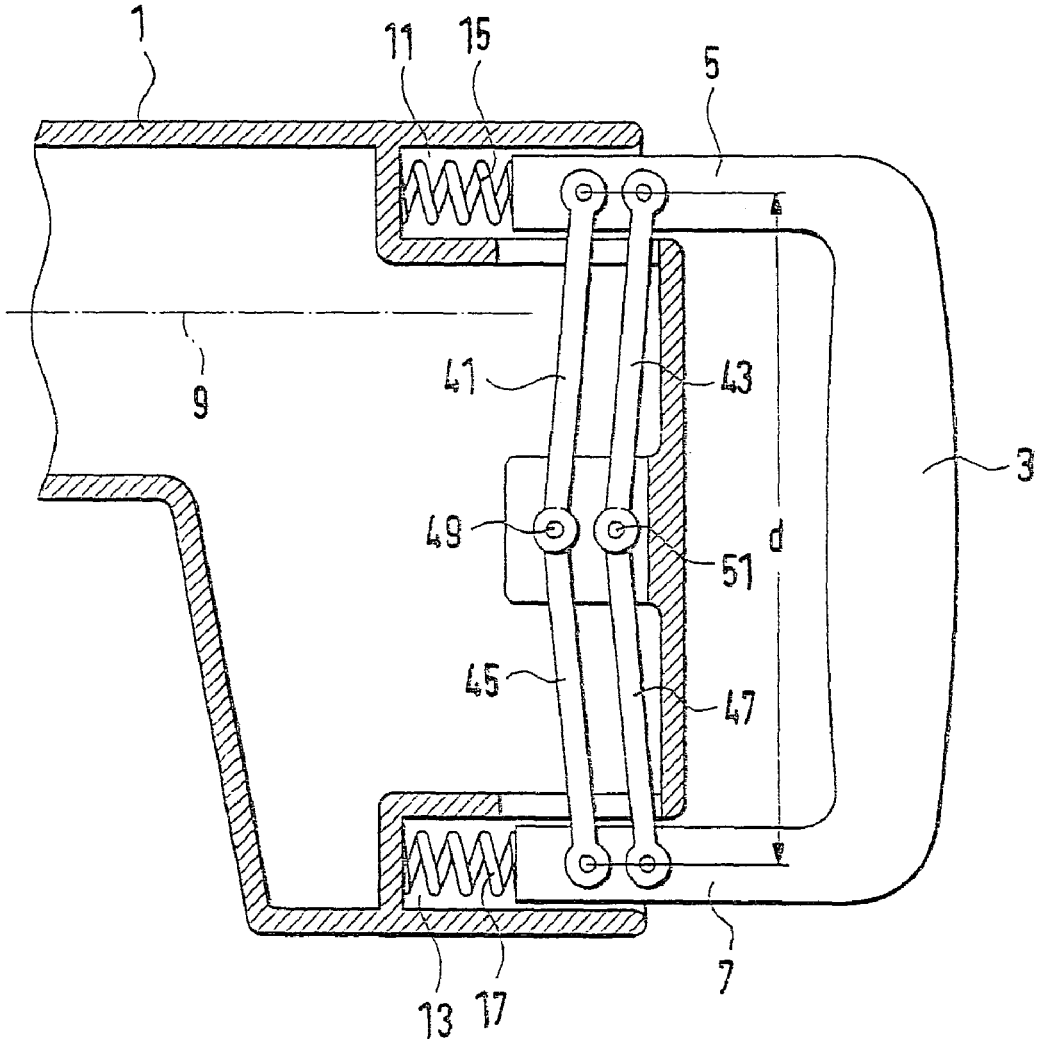
FIG. 3 is a schematic illustration of a handle supported on the machine housing by means of two parallel rocker arms.

A further exemplary embodiment of a hand power tool with vibration-damped handle 3 is shown in FIG. 3. All parts in this exemplary embodiment that have the same function as in the exemplary embodiments described hereinabove have the same reference numerals as those used in FIGS. 1 and 2. The details described in conjunction with FIGS. 1 and 2 will therefore not be discussed in further. The main difference between the exemplary embodiment shown in FIG. 3 and the exemplary embodiments described hereinabove is the lever mechanism that interconnects the handle 3 and the machine housing 1. While each leg 5, 7 in the exemplary embodiments according to FIGS. 1 and 2 is interconnected with the machine housing 1 via only one lever, two parallel levers 41 and 43 are hinge-mounted on the legs 5 of the handle 3 and on the machine housing 1, and two parallel levers 45 and 47 are also hinge-mounted on the leg 7 and the machine housing 1. In other words, each of the two legs 5, 7 is interconnected with the machine housing with spring action via a "parallel rocker arm" 41, 43 and 45, 47. The parallel rocker arms 41, 43 and 45, 47 give the handle 3 stable support that is free of play, and they greatly suppress undesired component motions induced by movement of the handle and travel in the direction of the machine's longitudinal axis 9.

With the exemplary embodiment in FIG. 3, each of the opposing levers 41, 45 and 43, 47 of the two parallel rocker arms shares a common hinge point 49, 51 on the machine housing 1. However, as with the exemplary embodiment according to FIG. 1, the opposing levers 41, 45 and 43, 47 can also have hinge points located next to each other and they can also be equipped with roundings on their ends that have meshing teeth. With this, a very high level of synchronicity of the motions of the two legs 5 and 7 of the handle 3 is obtained.

What is claimed is:

1. A hand power tool having a longitudinal axis (9), and comprising a machine housing (1), a vibration-damped handle that has two legs (5, 7) extending nearly parallel to the longitudinal axis (9) and coupled with the machine housing (1) with spring biasing, and two levers (19, 21) oriented substantially at a right angle to the longitudinal axis (9), wherein each of the levers (19, 21) has one end which is hinge-mounted to a respective one of the two legs (5, 7) of the handle (3), and wherein each of the levers (19, 21, 41, 43, 45, 47) has the other end which is hinge-mounted to a single region of the machine housing (1) located between the two legs (5, 7) of the handle (3), wherein the ends of the levers (19, 21) hinge-mounted on the machine housing (1) comprise a roundness (27, 29) equipped with teeth (31, 33), and the hinge points (31, 33) of the levers (19, 21) are placed on the machine housing (1) in such a way that the teeth (31, 33) on the ends of the levers (19, 21) mesh with each other.

* * * * *